US006544071B1

(12) United States Patent
Wu

(10) Patent No.: US 6,544,071 B1
(45) Date of Patent: Apr. 8, 2003

(54) LIQUID CRYSTAL DISPLAY CONNECTOR

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/035,834

(22) Filed: Dec. 24, 2001

(51) Int. Cl.[7] ..... H01R 13/648
(52) U.S. Cl. ..... 439/607; 439/108; 439/676
(58) Field of Search ..... 439/676, 607, 439/608, 108

(56) References Cited

U.S. PATENT DOCUMENTS 6,129,562 A * 10/2000 Hong ..... 439/79
6,155,878 A * 12/2000 Chen ..... 439/607
6,190,205 B1 * 2/2001 Wu ..... 439/607
6,352,438 B1 * 3/2002 Wu ..... 439/92
6,354,875 B1 * 3/2002 Wu ..... 439/607
6,375,498 B1 * 4/2002 Yu et al. ..... 439/567
6,383,025 B1 * 5/2002 Shi et al. ..... 439/607
6,416,360 B1 * 7/2002 Zhang et al. ..... 439/607

* cited by examiner

*Primary Examiner*—P. Austin Bradley
*Assistant Examiner*—Truc Nguyen
(74) *Attorney, Agent, or Firm*—Wei Te Chung

(57) ABSTRACT

A connector (10) comprises a housing (20), a plurality of terminals (30) received in the housing, a conductive shield (40) enclosing the housing, and a pair of solder pads (50) assembled to the housing. A pair of channels (241) is defined at a pair of side walls (24) of the housing from a mating face (21) of the housing, and a pair of grooves (242) is defined in the pair of side walls from a rear wall (25) of the housing. The shield has a pair of resilient arms (431) at a pair of side portions thereof and respectively extending into the channels, and a plurality of bars (432) extending from the pair of side portions of the shield into the grooves to secure the shield to the housing. The pair of solder pads is received into the channels, and the resilient arms respectively electrically contact the solder pads.

4 Claims, 7 Drawing Sheets

LIQUID CRYSTAL DISPLAY CONNECTOR

BACKGROUND OF THE INVENTION

1. Field of the Invention

The present invention relates to a liquid crystal display (LCD) connector, and particularly to a LCD connector used in a notebook computer.

2. Description of Related Art

In the prior art, a LCD connector assembled in a notebook computer is used to transmit electrical signals between a liquid crystal display and a mother board mounted in a base of the notebook computer. The LCD connector usually has a shield or has no shield. The LCD connector with a shield has solder pads integrately formed on the shield for soldering to a printed circuit board, and a grounding trace is established from the shield to the printed circuit board. The LCD connector without a shield must have additional solder pads mounted thereon for soldering to the printed circuit board. The additional solder pads in the prior art are only used in the LCD connector without the shield. If the additional solder pads can be used in both the LCD connector with a shield and the LCD connector without a shield, the user can add or remove the shield in accordance with his or her requirement.

SUMMARY OF THE INVENTION

Accordingly, one object of the present invention is to provide a LCD connector with or without a shield.

A second object of the present invention is to provide the LCD connector with a shield assembled securely to the connector.

A third object of the present invention is to provide the LCD connector with a low cost.

A fourth object of the present invention is to provide the LCD connector having a good grounding effect.

In order to achieve the objects set forth, a LCD connector comprises a housing, a plurality of terminals received in the housing, a conductive shield enclosing the housing, and a pair of solder pads assembled to the housing. A pair of channels is defined at a pair of side walls of the housing from a mating face of the housing, and a pair of grooves is defined in the pair of side walls from a rear wall of the housing. The shield has a pair of resilient arms at a pair of side portions thereof and respectively extending into the channels, and a plurality of bars extending from the pair of side portions of the shield into the grooves to secure the shield to the housing. The pair of solder pads is received into the channels, and the resilient arms respectively electrically contact the solder pads. Other objects, advantages and novel features of the invention will become more apparent from the following detailed description when taken in conjunction with the accompanying drawings.

DETAILED DESCRIPTION OF THE INVENTION

Figure 1:
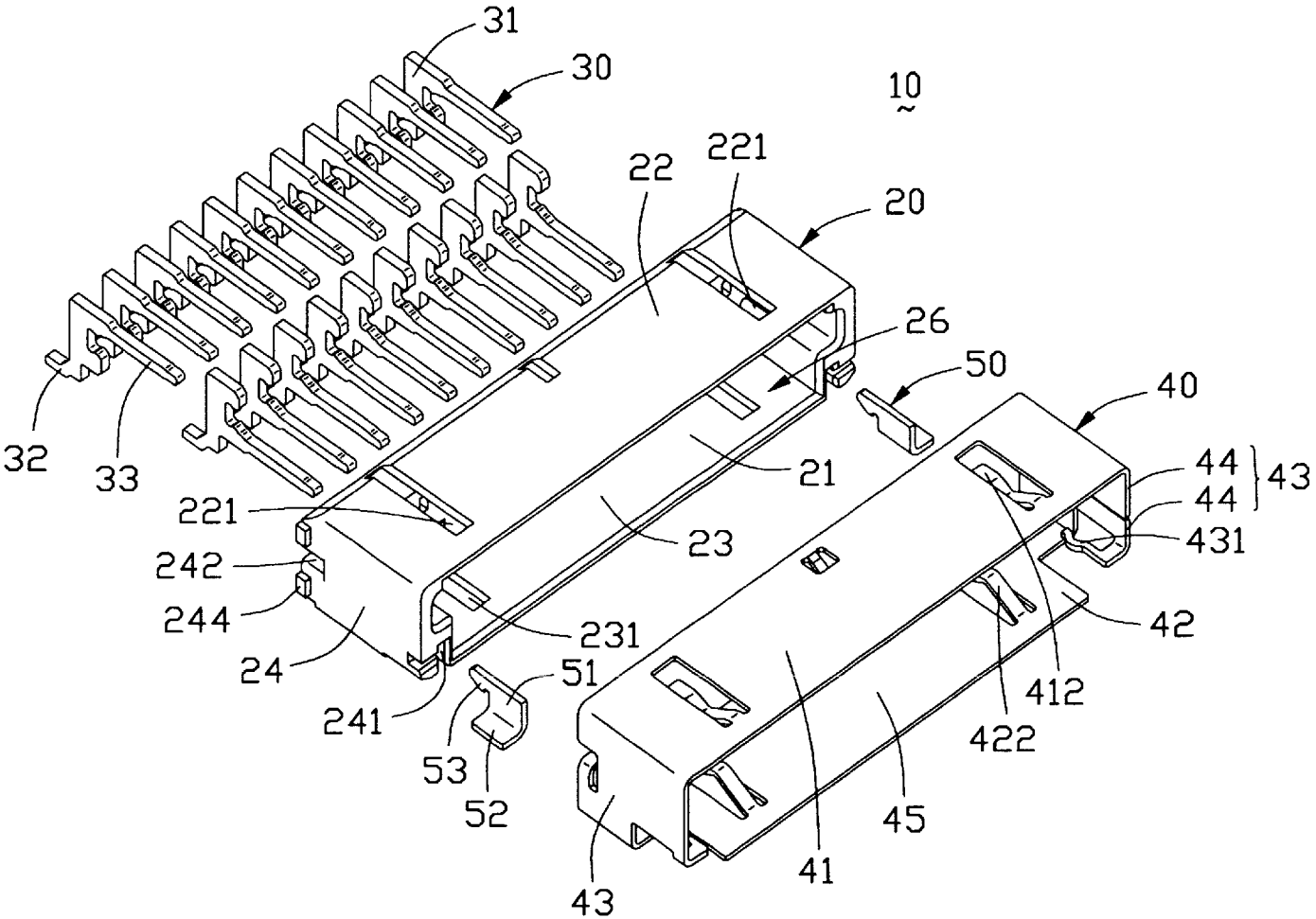
FIG. 1 is an exploded view of a LCD connector.
Figure 2:
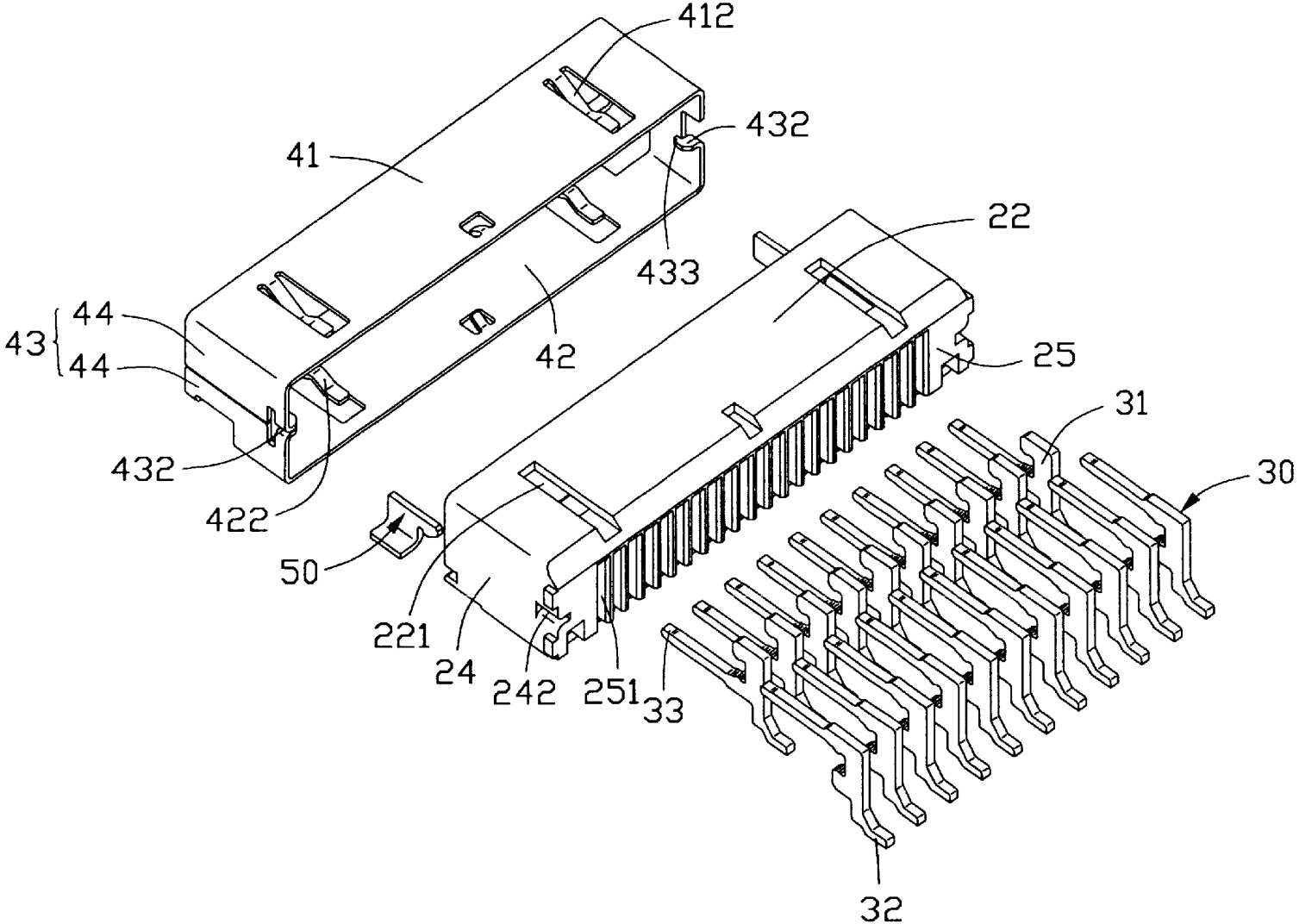
FIG. 2 is an exploded view of the LCD connector in another angle.

Referring to FIGS. 1 and 2, a liquid crystal display (LCD) connector 10 of the present invention comprises an insulative housing 20, a plurality of terminals 30, a shield 40, and a pair of solder pads 50.

The housing 20 comprises a mating face 21, an upper wall 22, a bottom wall 23, a pair of side walls 24, and a rear wall 25 which together define a mating port 26. A pair of slots 221 is defined in the upper wall 22 from an outer face (not labeled) thereof and a pair of slots 231 is defined in the bottom wall 23 from an outer face (not labeled) thereof. A pair of channels 241 is defined in the side walls 24 adjacent to the mating face 21, and a pair of grooves 242 is defined in the side walls 24 adjacent to the rear wall 25. A pair of blocks 244 is formed on each side wall 24 of the housing 20 for preventing the shield 40 from sliding rearwardly. A plurality of passageways 251 is defined in the rear wall 25 for receiving the terminals 30 therein.

Figure 6:
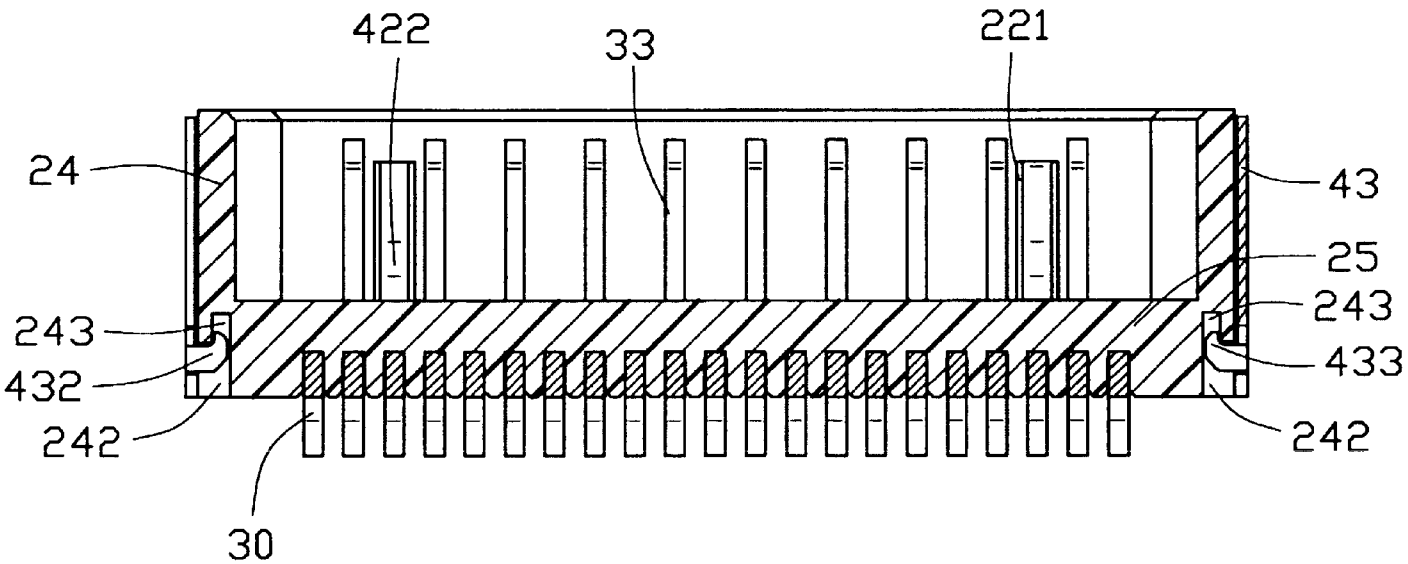
FIG. 6 is a cross sectional view of the LCD connector taken along line 6—6 of FIG. 5.
Figure 7:
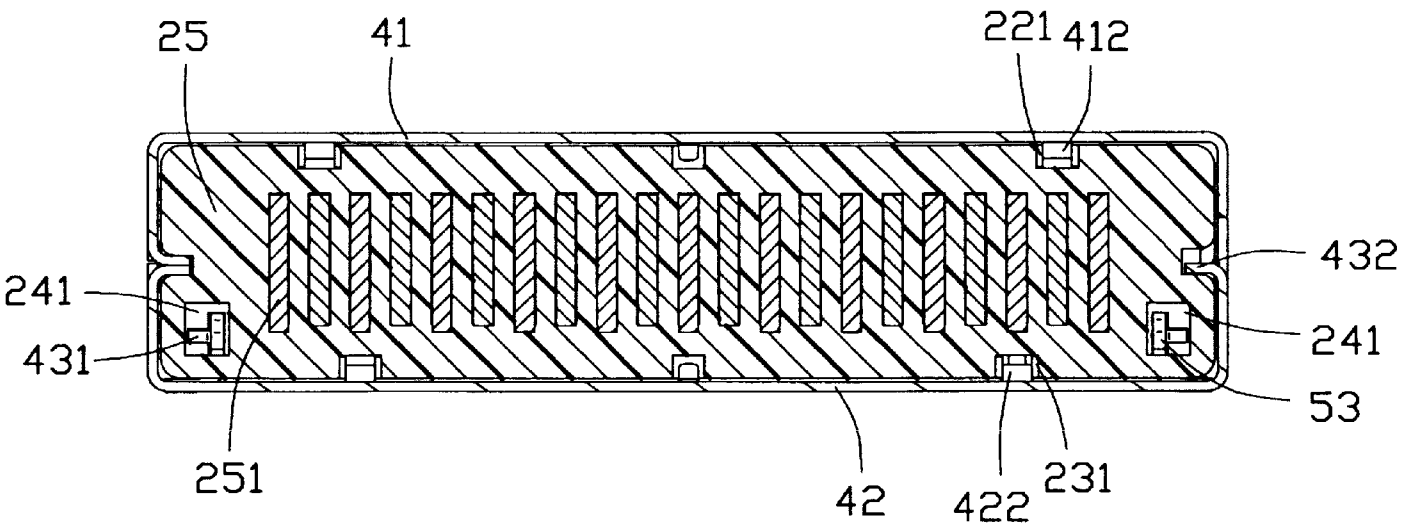
FIG. 7 is a cross sectional view of the LCD connector taken along line 7—7 of FIG. 5.

Referring to FIG. 6, each side wall 24 comprises a recess 243 communicating with the groove 242.

Referring to FIGS. 1 and 2, the terminal 30 comprises a base portion 31, a solder portion 32 extending downwardly from the base portion 31 for soldering the connector 10 to a printed circuit board (not shown), and a mating portion 33 extending forwardly from the base portion 31 for electrically contacting with a mating connector (not shown).

Referring to FIGS. 1 and 2, the conductive shield 40 is stamped from a metal sheet and a pair of end portions 44 of the metal sheet is bent to meet each other. The shield 40 comprises an upper portion 41, a bottom portion 42, a pair of side portions 43 which together define a receiving space 45. The pair of end portions 44 of the metal sheet together form one side portion 43. The upper wall 41 forms a pair of resilient tabs 412 corresponding to the slots 221 of the upper wall 22 of the housing 20. The bottom portion 42 forms a pair of resilient tabs 422 corresponding to the slots 231 of the bottom wall 23 of the housing 20. A pair of resilient arms 431 extends from both side portions 43 of the shield 40 and extends rearwardly into the receiving space 45. A plurality of bars 432 is formed on both side portions 43 of the shield 40 and extends into the receiving space 45.

Referring to FIGS. 2 and 6, each bar 432 has a latch portion 433 at an end thereof extending forwardly in the receiving space 45.

The solder pad 50 comprises a base portion 51 extending vertically, a solder portion 52 extending horizontally from the base portion 51, and an engaging portion 53 extending rearwardly from the base portion 51.

Figure 3:
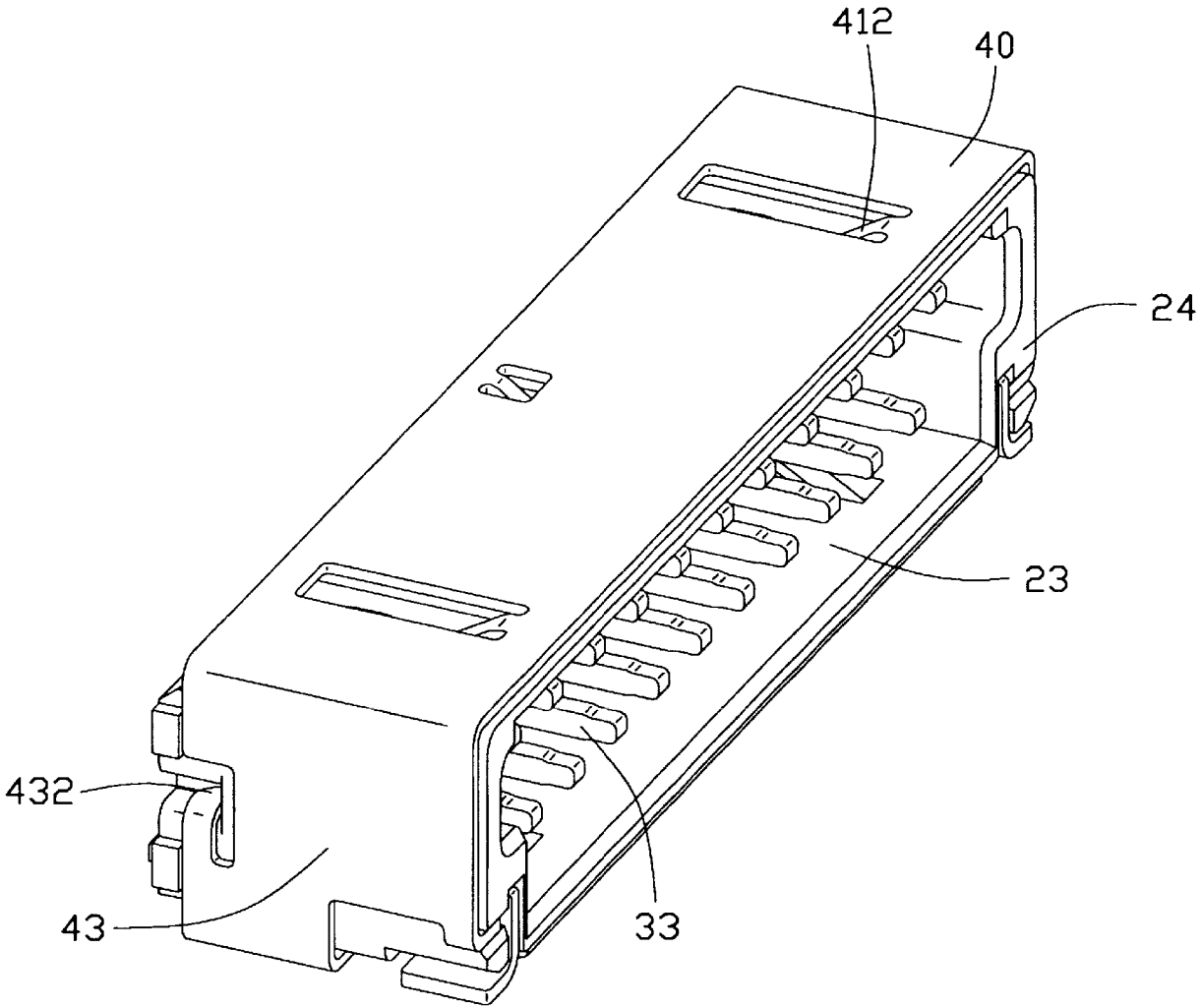
FIG. 3 is an assembled view of the LCD connector of FIG. 1.
Figure 4:
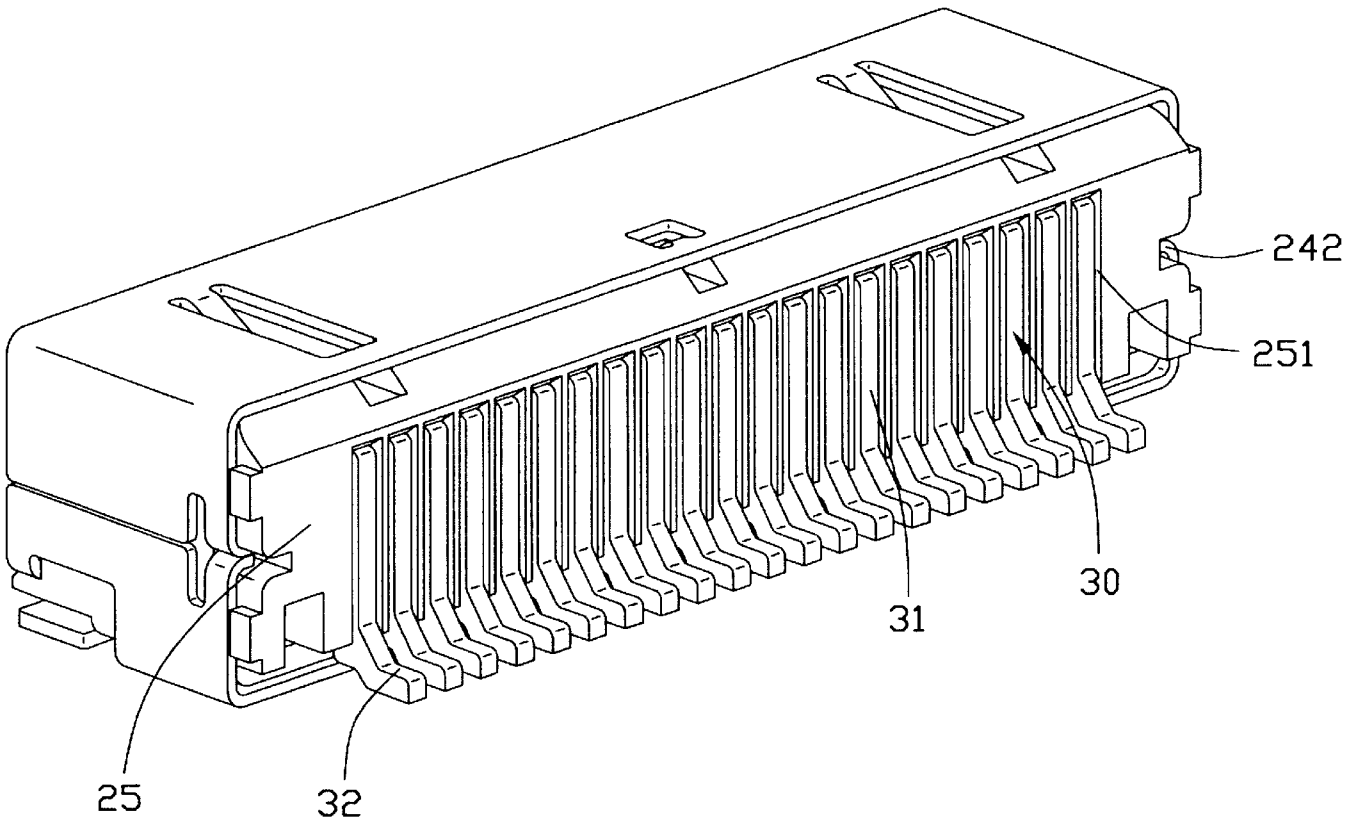
FIG. 4 is another assembled view of the LCD connector of FIG. 2.
Figure 5:
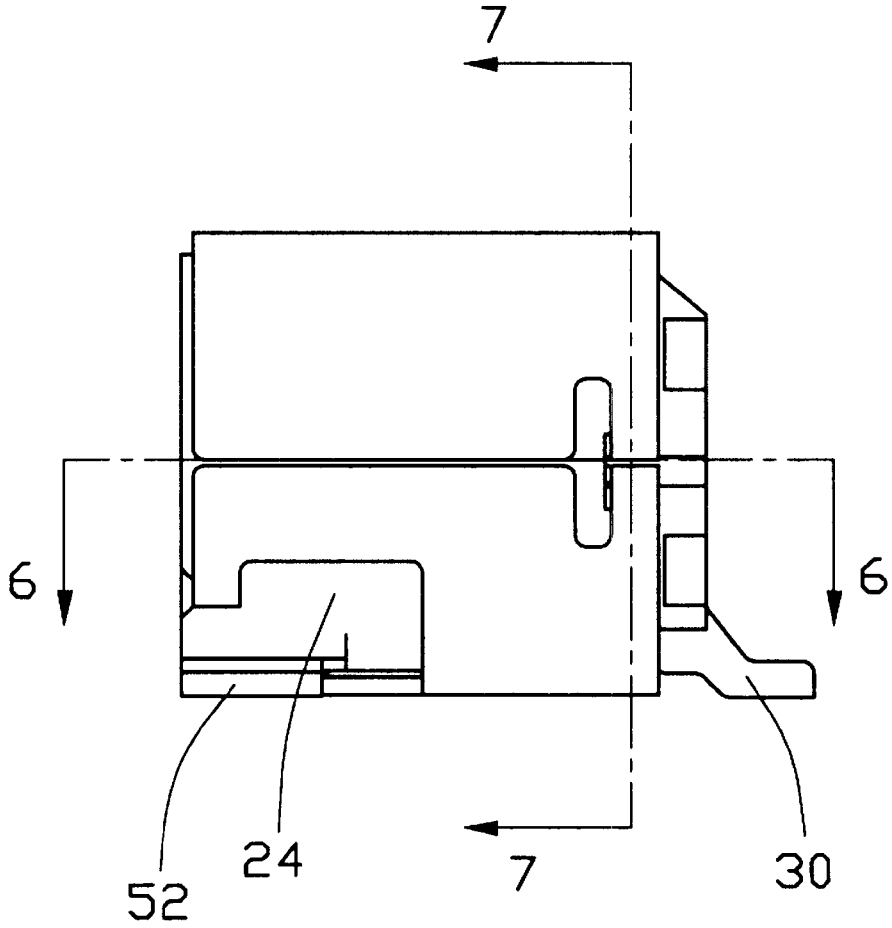
FIG. 5 is a side view of the LCD connector.

Referring to FIGS. 3 and 4, in assembly, each terminal 30 is first assembled into the housing 20 with the base portion 31 assembled into the passageway 251, the mating portion 33 extends into the mating port 26 of the housing 20, and the solder portion 32 extends outside the housing 20 for being soldered to the printed circuit board.

The pair of solder pads 50 are assembled into the channels 241 with each engaging portion 53 of each solder pad 50 engaging with the side wall 24, the solder portion 52 extending outside the housing 20 for being soldered to the printed circuit board.

Referring to FIGS. 3–7, the shield 40 is assembled to the housing 20 along a mating direction so that the bars 432 of the shield 40 first contact the side walls 24 of the housing 20 and the end portions 44 of the shield 40 are ejected to diverge with each other by the side wall 24 of the housing 20. When the shield 40 is further assembled to the housing 20, the bars 432 are inserted into the grooves 242 of the housing 20, and the latch portions 433 enter into the recesses 243 and securely fix the shield 40 to the housing 20. The resilient arms 431 enter into the channels 241 to contact with the base portions 51 of the solder pads 50. A grounding trace is established from the shield 40 to the solder pads 50. The resilient tabs 412 and 422 enter into the slots 221 and 231 to position the shield 40 to the housing 20. When the housing 20 is further inserted into the receiving space 44 of the shield 40, the blocks 244 of the side walls 24 of the housing stop the shield 40 and prevent the shield 40 from moving rearwardly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a front mating face and a rear wall, a plurality of passageways defined in the rear wall, a pair of channels defined in a pair of side walls thereof and extending from the front mating face, and a pair of grooves defined in the pair of side walls thereof adjacent to the rear wall;

a plurality of terminals assembled into the passageways of the housing;

a conductive shield enclosing the housing, the shield having a pair of resilient arms at a pair of side portions thereof adjacent to a front end of the shield, and the resilient arms extending rearward respectively into the channels from the front mating face of the housing, a plurality of bars formed on the side portions and adjacent to a rear end of the shield, and the bars extending forwardly into the grooves to securely fix the shield to the housing; and a pair of solder pads respectively received into the channels of the housing, the resilient arms of the shield respectively electrically contacting the solder pads; and wherein each side wall of the housing further defines a recess communicating with the respective groove of the housing, the bar of the shield further comprises a latch portion at an end thereof, and the latch portion is securely received into the recess when the shield is securely enclosed to the housing; and wherein the solder pad comprises a vertical base portion, a solder portion extending vertically from the base portion, and an engaging portion extending from the base portion and engaged with the side wall of the housing; and wherein the housing further comprises a plurality of blocks formed on the pair of the side walls of the housing, both the side portions of the shield are respectively stopped by the block to prevent the shield from moving rearwardly.

2. The electrical connector as described in claim 1, wherein the shield is stamped from one piece of metal sheet and the shield having a pair of end portions bent to meet with each other to form one side portion of the shield.

3. The electrical connector as described in claim 2, wherein the shield has a receiving space receiving the housing thereinto, and the resilient arms and the bars correspondingly extend into the receiving space in a mating direction and in an unmating direction.

4. The electrical connector as described in claim 3, wherein the shield has a plurality of resilient tabs extending into the receiving space thereof, the housing has a plurality of slots defined in the upper and bottom walls, the resilient tabs are respectively received into the slots to position the housing to the shield.

* * * * *